US010308459B2

(12) United States Patent
Hamano et al.

(10) Patent No.: US 10,308,459 B2
(45) Date of Patent: Jun. 4, 2019

(54) MEDIUM WIND-UP APPARATUS

(71) Applicant: SEIKO EPSON CORPORATION, Tokyo (JP)

(72) Inventors: Ryo Hamano, Matsumoto (JP); Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 256 days.

(21) Appl. No.: 15/462,452

(22) Filed: Mar. 17, 2017

(65) Prior Publication Data

US 2017/0275130 A1 Sep. 28, 2017

(30) Foreign Application Priority Data

Mar. 24, 2016 (JP) ..... 2016-059683

(51) Int. Cl.

| | |
|---|---|
| ***B65H 18/10*** | (2006.01) |
| ***B65H 23/16*** | (2006.01) |
| ***B65H 23/18*** | (2006.01) |
| ***B65H 23/185*** | (2006.01) |
| ***B65H 23/192*** | (2006.01) |
| ***B65H 23/198*** | (2006.01) |
| ***B41J 15/04*** | (2006.01) |

(52) U.S. Cl.

CPC ..... *B65H 18/103* (2013.01); *B41J 15/04* (2013.01); *B65H 23/16* (2013.01); *B65H 23/185* (2013.01); *B65H 23/1806* (2013.01); *B65H 23/192* (2013.01); *B65H 23/198* (2013.01); *B65H 2301/517* (2013.01); *B65H 2301/5143* (2013.01); *B65H 2403/942* (2013.01); *B65H 2513/11* (2013.01); *B65H 2553/51* (2013.01); *B65H 2557/242* (2013.01); *B65H 2557/2644* (2013.01); *B65H 2801/36* (2013.01)

(58) Field of Classification Search

CPC ..... B65H 18/103; B65H 23/1806; B65H 23/185; B65H 23/192; B65H 23/198; B65H 2403/942; B65H 2301/517; B65H 2301/5143; B65H 2801/36; B65H 2557/242; B65H 2557/2644; B65H 2553/51; B65H 2513/11; B41J 15/04

See application file for complete search history.

(56) References Cited

U.S. PATENT DOCUMENTS

2009/0269119 A1 10/2009 Hatada et al.

FOREIGN PATENT DOCUMENTS

JP 2009-280398 12/2009

*Primary Examiner* — William E Dondero
(74) *Attorney, Agent, or Firm* — Workman Nydegger

(57) ABSTRACT

A medium wind-up apparatus includes a reel-out motor, which is a driving source that winds up a medium, a control portion that controls the reel-out motor on the basis of a torque limit value, which regulates an upper limit of an output torque of the reel-out motor, and a reel-out side detection portion that detects a rotation speed of the reel-out motor, in which the control portion changes the torque limit value on the basis of the detected rotation speed. In this case, it is preferable that the control portion increase the torque limit value in a case in which the detected rotation speed falls below a first threshold value, and that the control portion reduce the torque limit value in a case in which the detected rotation speed exceeds a second threshold value, which is larger than the first threshold value.

5 Claims, 5 Drawing Sheets

MEDIUM WIND-UP APPARATUS

BACKGROUND

1. Technical Field

The present invention relates to a medium wind-up apparatus.

2. Related Art

A printer, which is an example of a medium wind-up apparatus, will be described. Among printers, apparatuses that are configured to rewind a medium by rotating a roll body in a direction that is opposite to that during reeling out using a roll motor in order to resolve sagging caused in the medium between the roll body and a transport driving roller, are known (refer to JP-A-2009-280398).

In a medium wind-up apparatus, in a case in which the roll load, that is, the load that is placed on a motor when a roll body is rotated, is increased in order to prevent a circumstance in which sagging occurs in the medium as a result of the rotation of the roll body being delayed, when the output torque of the motor is set to be high, the current that flows through the motor also increases.

SUMMARY

An advantage of some aspects of the invention is to provide a medium wind-up apparatus that can reduce the current that flows through a motor.

According to an aspect of the invention, there is provided a medium wind-up apparatus including a motor, which is a driving source that winds up a medium, a control portion that controls the motor on the basis of a torque limit value, which regulates an upper limit of an output torque of the motor, and a detection portion that detects a rotation speed of the motor, in which the control portion changes the torque limit value on the basis of the detected rotation speed.

According to this configuration, since the torque limit value is changed on the basis of the detected rotation speed, a circumstance in which the motor operates at an output torque that is unnecessarily high is suppressed. As a result of this, it is possible to reduce the current that flows through the motor.

In this case, it is preferable that the control portion decrease the torque limit value in a case in which the detected rotation speed exceeds a threshold value.

According to this configuration, the output torque is decreased after the detected rotation speed exceeds the threshold value. Therefore, in a case in which the motor is rotating at high speed, a circumstance in which the motor operates at an output torque that is unnecessarily high is suppressed.

In this case, it is preferable that the control portion increase the torque limit value in a case in which the detected rotation speed falls below a threshold value.

According to this configuration, it is possible to decrease the output torque until the detected rotation speed falls below the threshold value. Therefore, a circumstance in which the motor operates at an output torque that is unnecessarily high is suppressed. In addition, since the output torque is increased after the detected rotation speed falls below the threshold value, even in a case in which sagging occurs in the medium as a result of the rotation speed of the motor decreasing, it is possible to reduce the sagging of the medium.

In this case, it is preferable that the control portion increase the torque limit value in a case in which the detected rotation speed falls below a first threshold value, and that the control portion reduce the torque limit value in a case in which the detected rotation speed exceeds a second threshold value, which is larger than the first threshold value.

According to this configuration, after the detected rotation speed exceeds the second threshold value, the output torque is decreased until the detected rotation speed falls below the first threshold value. In addition, since the output torque is increased after the detected rotation speed falls below the first threshold value, even in a case in which sagging occurs in the medium as a result of the rotation speed of the motor decreasing, it is possible to reduce the sagging of the medium. Furthermore, the output torque is decreased again when the rotation speed of the motor is increased and the detected rotation speed exceeds the second threshold value as a result of the output torque increasing. Accordingly, it is possible to reduce sagging that occurs in the medium, and it is possible to suppress a circumstance in which the motor operates at an output torque that is unnecessarily high.

In this case, it is preferable that the medium wind-up apparatus further include a reel-out portion that includes the motor and in which a roll body, around which the medium is wound, is set, and a wind-up portion that winds up the medium that is reeled out from the roll body, and that the control portion change the torque limit value on the basis of the detected rotation speed when the medium wound up by the wind-up portion is rewound by the reel-out portion.

According to this configuration, it is possible to reduce the current that flows through the motor when the medium that is wound up by the wind-up portion is rewound by the reel-out portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus 1, which is an embodiment of a medium wind-up apparatus of the invention, will be described with reference to the appended drawings.

Figure 1:
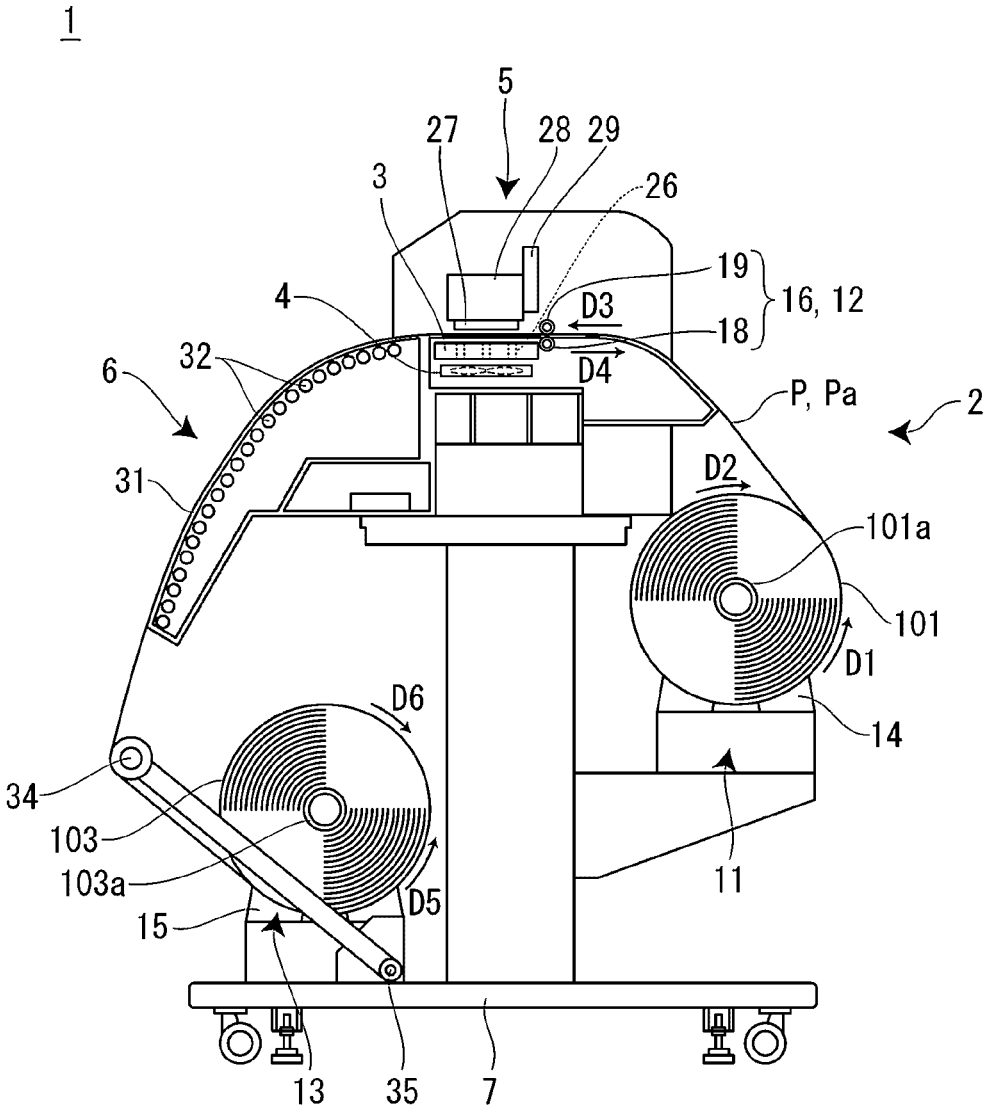
FIG. 1 is a view that shows a schematic configuration of a recording apparatus according to an embodiment of the invention.

A schematic configuration of the recording apparatus 1 will be described on the basis of FIG. 1. The recording apparatus 1 is a recording apparatus that prints images on a medium P using an ink jet method while feeding the medium P. The recording apparatus 1 is provided with a medium feeding mechanism 2, a platen 3, a suction fan 4, a recording portion 5, a drying portion 6, and a support frame 7 that supports these components.

The medium feeding mechanism 2 feeds a long form medium P to a wind-up side roll body 103 from a reel-out side roll body 101 using a roll-to-roll method. The reel-out side roll body 101 is a roll body in which the medium P is wound around a reel-out side core 101*a* (for example, a paper tube). The wind-up side roll body 103 is a roll body in which the medium P, which is reeled out from the reel-out side roll body 101 and on which an image is printed by the recording portion 5, is wound up onto a wind-up side core 103*a*. Additionally, for example, various materials, such as paper, film, or fabric, can be used as the medium P. For example, the maximum width, maximum diameter (diameter), and maximum weight of a reel-out side roll body 101 that can be set in the recording apparatus 1 are respectively 64 inches (approximately 1.6 m), 250 mm, and 80 kg. The medium feeding mechanism 2 is provided with a reel-out portion 11, a feeding portion 12, and a wind-up portion 13.

The reel-out side roll body 101 is set in the reel-out portion 11. The reel-out portion 11 is provided with a reel-out side support portion 14 and a reel-out motor 21 (refer to FIG. 2). The reel-out side support portion 14 supports the reel-out side roll body 101 so as to be capable of rotating. The reel-out motor 21 is a driving source that rotates the reel-out side roll body 101. For example, it is possible to use a DC (Direct Current) motor as the reel-out motor 21. As a result of the reel-out motor 21 rotating one of normally or in reverse, the reel-out side roll body 101 is rotated in a reel-out direction D1 so that the medium P is reeled out from the reel-out side roll body 101. In addition, as a result of the reel-out motor 21 rotating in the other of normally and in reverse, the reel-out side roll body 101 rotates in a rewind direction D2 so that the medium P is rewound onto the reel-out side roll body 101.

The feeding portion 12 feeds the medium P reeled out from the reel-out side roll body 101 toward the wind-up portion 13. The feeding portion 12 is provided with a feeding roller 16 and a feeding motor 22 (refer to FIG. 2). The feeding roller 16 is provided with a driving roller 18 and a driven roller 19. The driving roller 18 and the driven roller 19 feed the medium P in a manner in which the medium P is held therebetween. The feeding motor 22 is a driving source that rotates the driving roller 18. For example, it is possible to use a DC motor as the feeding motor 22. As a result of the feeding motor 22 rotating one of normally or in reverse, the medium P is fed in a feeding direction D3. In addition, as a result of the feeding motor 22 rotating in the other of normally and in reverse, the medium P is fed in a reverse feeding direction D4, which is a direction that is opposite to the feeding direction D3.

The wind-up portion 13 winds up the medium P fed thereto in roll form. The wind-up portion 13 is provided with a wind-up side support portion 15 and a wind-up motor 23 (refer to FIG. 2). The wind-up side support portion 15 supports the wind-up side core 103*a* so as to be capable of rotating. The tip end portion of the medium P is attached to the wind-up side core 103*a*. The wind-up motor 23 is a driving source that rotates the wind-up side core 103*a*. For example, it is possible to use a DC motor as the wind-up motor 23. When the wind-up motor 23 is rotated one of normally or in reverse, the wind-up side core 103*a* rotates in a wind-up direction D5, and the medium P is wound up onto the wind-up side core 103*a*. As a result of this, the wind-up side roll body 103 is formed. When the wind-up motor 23 is rotated the other of normally and in reverse, the wind-up side core 103*a* rotates in a carryback direction D6 that is opposite to the wind-up direction, and the medium P wound up on the wind-up side core 103*a* is carried back.

The platen 3 is provided further on the downstream side of a feeding pathway Pa than the feeding roller 16. A plurality of suction holes 26, which pass through the top and bottom of the platen 3, are formed in the platen 3. The suction fan 4 is provided below the platen 3. As a result of the suction fan 4 being operated, the insides of the suction holes 26 reach negative pressures, and the medium P on the platen 3 is suction held. Ink is discharged onto the medium P that is suction held on the platen 3 from a recording head 27, which will be mentioned later.

The recording portion 5 records images on the medium P. The recording portion 5 is provided with the recording head 27, a carriage 28, and a carriage movement mechanism 29. The recording head 27 discharges ink onto the medium P adsorbed onto the upper surface of the platen 3. The recording head 27 is mounted in the carriage 28. The carriage movement mechanism 29 causes the carriage 28 to reciprocate in a direction that intersects the feeding direction D3 of the medium P.

The drying portion 6 is provided further on the downstream side than the recording portion 5 in the feeding pathway Pa of the medium P that reaches from the reel-out side roll body 101 to the wind-up side roll body 103. The drying portion 6 is provided with an aluminum plate 31, and a tube heater 32 that is provided on the rear surface of the aluminum plate 31. As a result of the tube heater 32 generating heat, drying of the medium P is accelerated when the medium P, to which ink has been applied, passes over the upper surface of the aluminum plate 31.

A tension bar 34 is provided on the support frame 7. The tension bar 34 is supported by a bar support shaft 35 to be capable of swinging. The tension bar 34 applies tension to the medium P as a result of coming into contact with the medium P that passes through the drying portion 6. As a result of this, the medium P is wound up by the wind-up portion 13 in a state in which an appropriate amount of tension is applied to the medium P.

Figure 2:
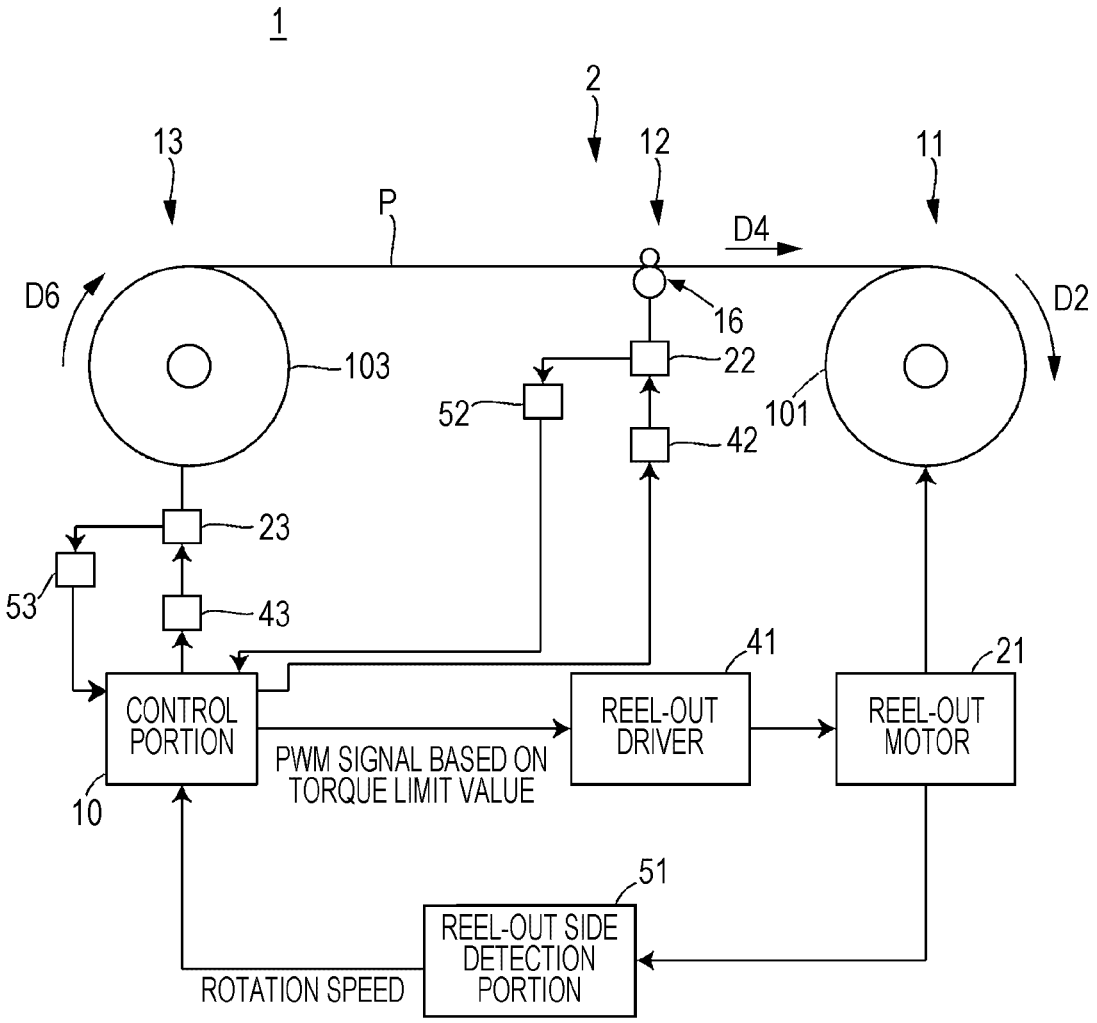
FIG. 2 is a control block diagram relating to a medium feeding mechanism of the recording apparatus.

A control configuration relating to the medium feeding mechanism 2 of the recording apparatus 1 will be described on the basis of FIG. 2. The recording apparatus 1 is provided with a control portion 10, a reel-out driver 41, a feeding driver 42, a wind-up driver 43, a reel-out side detection portion 51, a feeding detection portion 52, and a wind-up side detection portion 53.

The control portion 10 performs integrated control of each portion of the recording apparatus 1. Although illustration is omitted from the drawings, the control portion 10 is provided with a central processing unit (CPU), read only memory (ROM), random access memory (RAM), programmable ROM (PROM), an application specific integrated circuit (ASIC), and a bus.

In addition, a host device (for example, a personal computer), which is not illustrated in the drawings, is connected to the control portion 10 in a manner in which communication can be performed. When a recording job is received from the host device, the control portion 10 controls each portion of the recording apparatus 1 on the basis of the received recording job. As a result of this, the recording apparatus 1 performs alternate repetition of a dot formation operation and a feeding operation. In this instance, the dot formation operation is an operation that discharges an ink from the recording head 27 while moving the carriage 28 in a direction that intersects the feeding direction D3, and can also be referred to as a main scan. The feeding operation is an operation that feed the medium P in the feeding direction D3, and can also be referred to as a sub-scan.

The reel-out driver 41, the feeding driver 42, and the wind-up driver 43 respectively drive the reel-out motor 21, the feeding motor 22, and the wind-up motor 23 on the basis of a pulse width modulation (PWM) signal that is output from the control portion 10.

The reel-out side detection portion 51, the feeding detection portion 52, and the wind-up side detection portion 53 respectively detect the rotation speed of the reel-out motor 21, the rotation speed of the feeding motor 22, and the rotation speed of the wind-up motor 23. For example, it is possible to use a rotary encoder provided in the reel-out motor 21 as the reel-out side detection portion 51. The rotational position of the reel-out motor 21 is expressed as a count value of an output pulse from the reel-out side detection portion 51, and the amount of change in the rotational position of the reel-out motor 21 per unit time corresponds to the rotation speed of the reel-out motor 21. The same applies to the feeding detection portion 52 and the wind-up side detection portion 53.

The recording apparatus 1, which is configuration in this manner, is capable of rewinding the medium P wound up by the wind-up portion 13 to the reel-out portion 11 on the basis of an instruction, or the like, received by an operation panel, which is not illustrated in the drawings. At this time, the control portion 10 respectively controls the wind-up motor 23, the feeding motor 22, and the reel-out motor 21 so that the medium P is fed in the reverse feeding direction D4 by the feeding roller 16 as a result of the wind-up side roll body 103 rotating in the carryback direction D6, and so that the reel-out side roll body 101 rotates in the rewind direction D2. Additionally, at this time, the control portion 10 performs PID control of the feeding motor 22 on the basis of a speed table that changes the speed in the order of acceleration, constant speed, and deceleration.

When the medium P wound up by the wind-up portion 13 is rewound by the reel-out portion 11, the control portion 10 controls the reel-out motor 21 on the basis of a torque limit value so that the rotation of the reel-out side roll body 101 is not delayed with respect to feeding speed of the medium P by the feeding roller 16, or so that the reel-out side roll body 101 does not pull the medium P too much, or the like.

The torque limit value is a value that regulates the upper limit of the output torque of the reel-out motor 21. That is, for example, the control portion 10 compares a control value obtained by performing PID control based on the deviation between a target speed and a current speed of the reel-out motor 21 with the torque limit value. In a case in which the control value does not exceed the torque limit value, the control portion 10 outputs a duty value of the PWM signal based on the control value to the reel-out driver 41. On the other hand, in a case in which the control value exceeds the torque limit value, the control portion 10 outputs a duty value of the PWM signal based on the torque limit value to the reel-out driver 41. As a result of this, the upper limit of the output torque of the reel-out motor 21 is restricted to a value based on the torque limit value.

Figure 3:
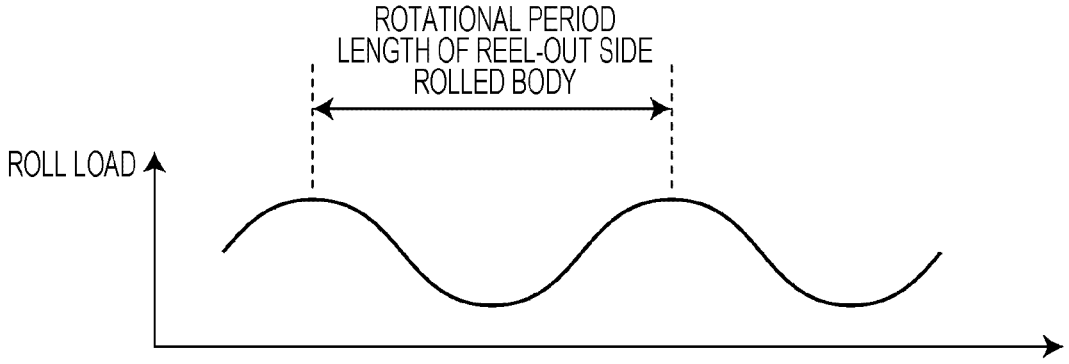
FIG. 3 is a view for describing changes in a roll load.

Incidentally, as shown in FIG. 3, the roll load, that is, the load (torque) that is applied to the reel-out motor 21 when the reel-out side roll body 101 is rotated, fluctuates in conjunction with the rotational period length of the reel-out side roll body 101 as a result of the influence of decentering of the reel-out side roll body 101. Therefore, when the torque limit value is set to a value that corresponds to an average value of the fluctuating roll load, the output torque of the reel-out motor 21 falls below the roll load at a timing at which the roll load increases. In this case, the rotation of the reel-out side roll body 101 is delayed, and sagging occurs in the medium P between the reel-out side roll body 101 and the feeding roller 16.

Therefore, in a control method of the reel-out motor 21, which is a reference example of the invention, the torque limit value is set to a value (a first limit value L1) that is higher than a value that corresponds to the maximum value of the fluctuating roll load.

Figure 4:
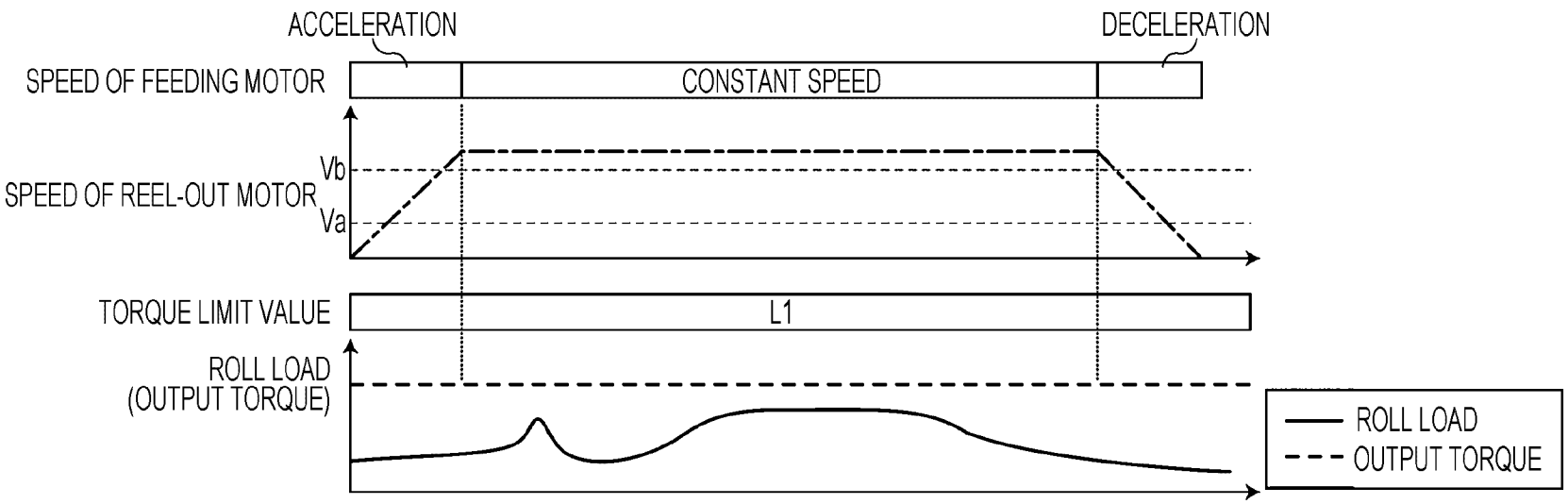
FIG. 4 is a view for describing a reference example of a control method of a reel-out motor.

The reference example of the control method of the reel-out motor 21 will be described specifically with reference to FIG. 4. In the example shown in FIG. 4, even at a timing at which the roll load increases, the output torque of the reel-out motor 21 based on the first limit value L1 exceeds the roll load. Therefore, the medium P is retained in a state of being pulled taut between the reel-out side roll body 101 and the feeding roller 16, and the reel-out motor 21 operates following the speed of the feeding motor 22. In this manner, the medium P is stably rewound as a result of the control portion 10 controlling the reel-out motor 21 on the basis of the torque limit value, which is set to the first limit value L1.

Additionally, the roll load fluctuates depending on the rotation speed of the reel-out side roll body 101 and the radius of the reel-out side roll body 101, but in order to simplify the description, in the examples shown in FIGS. 4 and 5, which will be mentioned later, the influence of such fluctuation will be treated as insignificant. In addition, in the examples shown in FIGS. 4 and 5, which will be mentioned later, the reel-out motor 21 outputs torque based on the torque limit value. That is, the control portion 10 outputs a duty value of the PWM signal based on the torque limit value rather than the control value to the reel-out driver 41.

Incidentally, when the medium P is reeled out from the reel-out side roll body 101, the reel-out motor 21 outputs torque that is lower than the roll load so that a predetermined amount of tension is applied to the medium P between the reel-out side roll body 101 and the feeding roller 16. In contrast to this, when the medium P is rewound to the reel-out side roll body 101, the reel-out motor 21 outputs torque that is higher than the roll load in the above-mentioned manner. Therefore, when the medium P is rewound, the reel-out motor 21 outputs higher torque than a case in which the medium is reeled out. Further, since a current that is proportionate to the output torque flows through the reel-out motor 21, when the medium P is rewound, the current that flows through the reel-out motor 21 is greater than a case in which the medium is reeled out.

Additionally, in the above-mentioned reference example, since the control portion 10 sets the torque limit value to the same value (the first limit value L1) in a case in which the roll load is small and in a case in which the roll load is large, the reel-out motor 21 outputs torque that is unnecessarily high in a case in which the roll load is small. Therefore, the current that flows through the reel-out motor 21 rises further.

As a result of this, particularly in a case in which the medium P is rewound for a long period of time, the amount of heat generation of the reel-out motor 21 exceeds a heat generation restriction amount, and it becomes necessary to take time in order to cool the reel-out motor 21. Additionally, examples of cases in which the medium P is rewound over a long period of time include a case in which the medium P of a whole roll body is continuously rewound to the reel-out portion 11 from the wind-up portion 13 in order for a user to check the printing quality after printing of a whole reel-out side roll body 101 is performed.

In such an instance, in the present embodiment, the control portion 10 reduces the current that flows through the motor by altering the torque limit value in accordance with the rotation speed of the reel-out motor 21, which is detected by the reel-out side detection portion 51. That is, in a case in which the rotation speed of the reel-out motor 21 falls below a first threshold value Va, the control portion 10 sets the torque limit value to the first limit value L1. In addition, in a case in which the rotation speed of the reel-out motor 21 exceeds a second threshold value Vb, which is greater than the first threshold value Va, the control portion 10 sets the torque limit value to a second limit value L2, which is smaller than the first limit value L1. In other words, the control portion 10 makes the torque limit value high in a case in which a wind-up delay of the medium P occurs, but makes the torque limit value low in a case in which a wind-up delay of the medium P by the reel-out side roll body 101 does not occur.

For example, the control portion 10 sets a value obtained by adding the torque calculated from a set value of the tension applied to the medium P between the reel-out side roll body 101 and the feeding roller 16, and the torque calculated from a measured value of the roll load. In this case, the control portion 10 alters the torque limit value by altering the set value of tension in accordance with the detected rotation speed of the reel-out motor 21.

The control portion 10 performs such alteration control of the torque limit value during constant speed control of the feeding motor 22. In a similar manner to that of the reference example, during acceleration control and deceleration control of the feeding motor 22, the control portion 10 sets the torque limit value to the first limit value L1 regardless of the detected rotation speed of the reel-out motor 21.

A control method of the reel-out motor 21 of the present embodiment will be described specifically with reference to FIG. 5. In the example shown in FIG. 5, the rotation speed of the reel-out motor 21 exceeds the second threshold value Vb at a timing at which the feeding motor 22 switches to the constant speed control, that is, at a timing at which the alteration control of the torque limit value is initiated. Therefore, the control portion 10 alters the torque limit value from the first limit value L1 to the second limit value L2. As a result of this, the output torque of the reel-out motor 21 is low, but at this point in time, since the output torque is higher than the roll load, the rotation speed of the reel-out motor 21 does not decrease.

Figure 5:
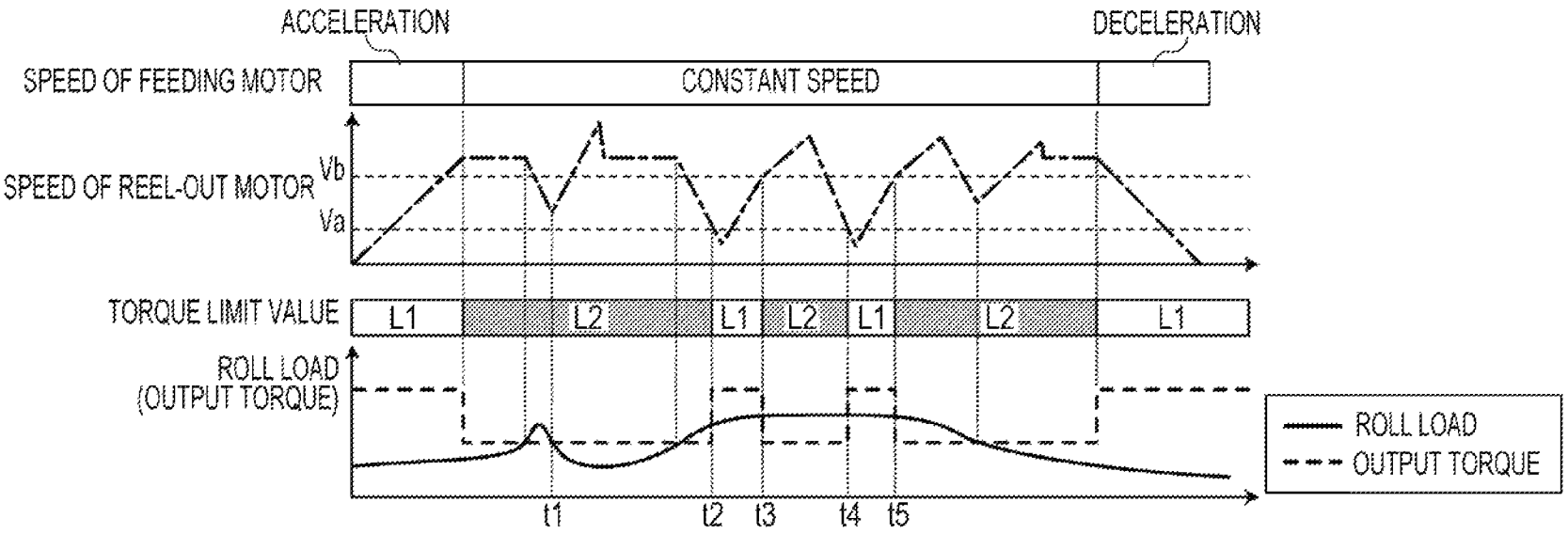
FIG. 5 is a view for describing a control method of a reel-out motor of the present embodiment.

A timing t1 of FIG. 5 shows a timing at which the rotation speed turns into an increase after the rotation speed of the reel-out motor 21 decreases temporarily in order for the roll load to temporarily increase and exceed the output torque. As a result of the rotation speed of the reel-out motor 21 temporarily decreasing, sagging occurs in the medium P between the reel-out side roll body 101 and the feeding roller 16, but thereafter, since the rotation speed of the reel-out motor 21 increases in accordance with a decrease in the roll load, the sagging of the medium P is resolved. After the sagging of the medium P is resolved, the medium P attains a pulled taut state, and the rotation speed of the reel-out motor 21 stabilizes. In this manner, in a case in which a state in which the roll load increases is temporary, the control portion 10 controls the reel-out motor 21 with the torque limit value still set as the second limit value L2.

The timing t2 and the timing t4 of FIG. 5 show timings at which the rotation speed of the reel-out motor 21 continuously decreases and falls below the first threshold value Va in order for the roll load to increase and exceed the output torque. At these times, the control portion 10 alters the torque limit value from the second limit value L2 to the first limit value L1. As a result of this, the output torque becomes higher than the roll load, and the rotation speed of the reel-out motor 21 continuously decreases in a temporary manner due to inertia, but thereafter, the rotation speed of the reel-out motor 21 increases.

The timing t3 and the timing t5 of FIG. 5 show timings at which the rotation speed of the reel-out motor 21, which was increased, exceeds the second threshold value Vb after the torque limit value is altered from the second limit value L2 to the first limit value L1. At these times, the control portion 10 alters the torque limit value from the first limit value L1 to the second limit value L2. As a result of this, the output torque becomes lower than the roll load, and the rotation speed of the reel-out motor 21 continuously increases in a temporary manner due to inertia, but thereafter, the rotation speed of the reel-out motor 21 decreases.

In this manner, in a case in which a state in which the roll is increased continues to a certain extent, the control portion 10 controls the reel-out motor 21 while repeatedly switches between the first limit value L1 and the second limit value L2.

In the above-mentioned manner, the recording apparatus 1 of the present embodiment is provided with the reel-out motor 21, the control portion 10, and the reel-out side detection portion 51. The reel-out motor 21 is a driving source that winds up the medium P. The control portion 10 controls the reel-out motor 21 on the basis of the torque limit value, which regulates the upper limit of the output torque of the reel-out motor 21. The reel-out side detection portion 51 detects the rotation speed of the reel-out motor 21. Further, the control portion 10 alters the torque limit value on the basis of the detected rotation speed of the reel-out motor 21.

According to this configuration, since the torque limit value is altered on the basis of the detected rotation speed of the reel-out motor 21, a circumstance in which the reel-out motor 21 operates at an output torque that is unnecessarily high, is suppressed. As a result of this, it is possible to reduce the current that flows through the reel-out motor 21. Accordingly, it is possible to reduce the amount of heat generation of the reel-out motor 21, and in particular, it is possible to reduce a circumstance in which the amount of heat generation of the reel-out motor 21 exceeds a heat generation restriction amount in a case in which the medium P is rewound over a long period of time.

In addition, in the recording apparatus 1 of the present embodiment, the control portion 10 decreases the torque limit value in a case in which the detected rotation speed of the reel-out motor 21 exceeds the second threshold value Vb.

According to this configuration, the output torque is decreased after the detected rotation speed of the reel-out motor 21 exceeds the second threshold value Vb. Therefore, in a case in which the reel-out motor 21 is rotating at high speed, a circumstance in which the reel-out motor 21 operates at an output torque that is unnecessarily high is suppressed.

In addition, in the recording apparatus 1 of the present embodiment, the control portion 10 increases the torque limit value in a case in which the detected rotation speed of the reel-out motor 21 falls below the first threshold value Va.

According to this configuration, the output torque is decreased until the detected rotation speed of the reel-out motor 21 falls below the first threshold value Va. Therefore, a circumstance in which the reel-out motor 21 operates at an output torque that is unnecessarily high is suppressed. In addition, since the output torque is increased after the detected rotation speed of the reel-out motor 21 falls below the first threshold value Va, even in a case in which sagging occurs in the medium P as a result of the rotation speed of the reel-out motor 21 decreasing, it is possible to reduce the sagging of the medium P.

In addition, in the recording apparatus 1 of the present embodiment, the control portion 10 increases the torque limit value in a case in which the detected rotation speed of the reel-out motor 21 falls below the first threshold value Va.

In addition, the control portion 10 decreases the torque limit value in a case in which the detected rotation speed of the reel-out motor 21 exceeds the second threshold value Vb, which is larger than the first threshold value Va.

According to this configuration, after the detected rotation speed of the reel-out motor 21 exceeds the second threshold value Vb, the output torque is decreased until the detected rotation speed falls below the first threshold value Va. In addition, since the output torque is increased after the detected rotation speed of the reel-out motor 21 falls below the first threshold value Va, even in a case in which sagging occurs in the medium P as a result of the rotation speed of the reel-out motor 21 decreasing, it is possible to reduce the sagging of the medium P. Furthermore, the output torque is decreased again when the rotation speed of the reel-out motor 21 is increased and the detected rotation speed of the reel-out motor 21 exceeds the second threshold value Vb as a result of the output torque increasing. Accordingly, it is possible to reduce sagging that occurs is the medium P, and it is possible to suppress a circumstance in which the reel-out motor 21 operates at an output torque that is unnecessarily high.

In addition, the recording apparatus 1 of the present embodiment is provided with the reel-out portion 11 and the wind-up portion 13. The reel-out portion 11 includes the reel-out motor 21, and the reel-out side roll body 101, around which the medium P is wound, is set therein. The wind-up portion 13 winds up the medium P reeled out from the reel-out side roll body 101. Further, the control portion 10 alters the torque limit value on the basis of the detected rotation speed of the reel-out motor 21 when the medium P wound up by the wind-up portion 13 is rewound by the reel-out portion 11.

According to this configuration, it is possible to reduce the current that flows through the reel-out motor 21 when the medium P wound up by the wind-up portion 13 is rewound by the reel-out portion 11.

Additionally, the reel-out motor 21 is an example of a "motor". The reel-out side detection portion 51 is an example of a "detection portion". The first threshold value Va and the second threshold value Vb are examples of "threshold values". The reel-out side roll body 101 is an example of a "roll body".

The invention is not limited to the above-mentioned embodiment, and naturally, can adopt various configurations within a range in which that does not depart from the aim thereof. For example, the invention can be altered to have a format such as that below.

The control portion 10 is not limited to this configuration that alters the torque limit value between the first limit value L1 and the second limit value L2 in accordance with the detected rotation speed of the reel-out motor 21, and may alter the torque limit value between three or more values. In addition, the control portion 10 may acquire a relationship equation of the torque limit value and the rotation speed of the reel-out motor 21 in advance, and alter the torque limit value by setting a value, which is obtained by substituting the detected rotation speed of the reel-out motor 21 into the relationship equation, as the torque limit value.

The control portion 10 may perform the alteration control of the torque limit value during acceleration control and deceleration control of the feeding motor 22 in addition to just during constant speed control of the feeding motor 22.

In addition to a case in which the medium P is wound up by the reel-out motor 21, the invention can also be applied to a case in which the medium P is wound up by the wind-up motor 23. That is, the control portion 10 may alter the torque limit value of the wind-up motor 23 on the basis of the rotation speed of the wind-up motor 23 that is detected by the wind-up side detection portion 53.

Application examples of the medium wind-up apparatus of the invention are not limited to an ink jet method recording apparatus, and for example, may also be a dot impact method recording apparatus, or an electrophotographic method recording apparatus. Furthermore, the invention is not limited to recording apparatuses and for example, the medium wind-up apparatus of the invention may also be applied to a drying device that carries out a drying treatment on a medium while feeding the medium or a surface treatment device that carries out a surface treatment on a medium while feeding the medium. In addition, the invention is not limited to a device that carries out such a process on a medium, and may also be applied to a device the merely winds up a medium.

This application claims priority under 35 U.S.C. § 119 to Japanese Patent Application No. 2016-059683, filed Mar. 24, 2016. The entire disclosure of Japanese Patent Application No. 2016-059683 is hereby incorporated herein by reference.

What is claimed is:

1. A medium wind-up apparatus comprising:

a motor, which is a driving source that winds up a medium;

a control portion that controls the motor on the basis of a torque limit value, which regulates an upper limit of an output torque of the motor; and a detection portion that detects a rotation speed of the motor, wherein the control portion changes the torque limit value on the basis of the detected rotation speed.

2. The medium wind-up apparatus according to claim 1, wherein the control portion decreases the torque limit value in a case in which the detected rotation speed exceeds a threshold value.

3. The medium wind-up apparatus according to claim 1, wherein the control portion increases the torque limit value in a case in which the detected rotation speed falls below a threshold value.

4. The medium wind-up apparatus according to claim 1, wherein the control portion increases the torque limit value in a case in which the detected rotation speed falls below a first threshold value, and wherein the control portion decreases the torque limit value in a case in which the detected rotation speed exceeds a second threshold value, which is larger than the first threshold value.

5. The medium wind-up apparatus according to claim 1, further comprising:

a reel-out portion that includes the motor and in which a roll body, around which the medium is wound, is set; and a wind-up portion that winds up the medium that is reeled out from the roll body, wherein the control portion changes the torque limit value on the basis of the detected rotation speed when the medium wound up by the wind-up portion is rewound by the reel-out portion.

* * * * *